US010297408B2

(12) United States Patent
Kalin et al.

(10) Patent No.: US 10,297,408 B2
(45) Date of Patent: May 21, 2019

(54) ENCLOSURE FOR THE OPERATION MECHANISM OF A CIRCUIT BREAKER

(71) Applicant: General Electric Technology GmbH, Baden (CH)

(72) Inventors: Daniel Kalin, Oberentfelden (CH); Peter Von Allmen, Kirchleerau (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 34 days.

(21) Appl. No.: 15/568,351

(22) PCT Filed: Apr. 18, 2016

(86) PCT No.: PCT/EP2016/058505
§ 371 (c)(1),
(2) Date: Oct. 20, 2017

(87) PCT Pub. No.: WO2016/169876
PCT Pub. Date: Oct. 27, 2016

(65) Prior Publication Data

US 2018/0122608 A1 May 3, 2018

(30) Foreign Application Priority Data

Apr. 20, 2015 (EP) ..... 15164288

(51) Int. Cl.
*H01H 71/02* (2006.01)
*H01H 9/04* (2006.01)

(52) U.S. Cl.
CPC ..... *H01H 71/0214* (2013.01); *H01H 9/04* (2013.01); *H01H 71/0264* (2013.01); *H01H 2071/0292* (2013.01)

(58) Field of Classification Search
CPC .. H01H 71/0214; H01H 9/04; H01H 71/0264; H01H 2071/029
See application file for complete search history.

(56) References Cited

U.S. PATENT DOCUMENTS 3,713,345 A 1/1973 Sands
4,158,757 A * 6/1979 Reichert ..... H01H 9/04 174/564

(Continued)

FOREIGN PATENT DOCUMENTS

GB 1 481 129 A 7/1977

OTHER PUBLICATIONS

Extended European Search Report and Opinion issued in connection with corresponding EP Application No. 15164288.1 dated Oct. 14, 2015.

(Continued)

*Primary Examiner* — Mohamad A Musleh
(74) *Attorney, Agent, or Firm* — GE Global Patent Operation; Scott R. Stanley

(57) ABSTRACT

An enclosure for the operating mechanism of a circuit breaker, this mechanism including a main shaft and secondary shafts, and a spring to actuate the mechanism. This enclosure includes a parallelepiped base having an open face and including a bottom wall opposite to its open face, this bottom wall having holes to receive bearings carrying the shafts; a supporting part including a main wall to be mounted at the open face of the base, the main wall including holes to receive bearings carrying the other extremities of the shafts; a cover to close the supporting part.

5 Claims, 3 Drawing Sheets

(56) References Cited

U.S. PATENT DOCUMENTS

| | | | | |
|---|---|---|---|---|
| 5,750,948 | A | 5/1998 | Amonett et al. | |
| 5,938,008 | A * | 8/1999 | Wehrli, III | H01H 3/3021 200/400 |
| 6,160,234 | A * | 12/2000 | Wehrli, III | H01H 3/3021 200/400 |
| 6,659,648 | B1 * | 12/2003 | Bogdon | H01H 71/70 200/400 |
| 7,227,091 | B2 | 6/2007 | Gacond et al. | |
| 9,953,780 | B2 * | 4/2018 | Hu | H01H 33/66 |
| 2018/0240636 | A1 * | 8/2018 | Pan | H01H 71/12 |

OTHER PUBLICATIONS

International Search Report and Written Opinion issued in connection with corresponding PCT Application No. PCT/EP2016/058505 dated Jul. 7, 2016.

* cited by examiner

ENCLOSURE FOR THE OPERATION MECHANISM OF A CIRCUIT BREAKER

BACKGROUND OF THE INVENTION

Embodiments of the invention relate to the enclosure of an operation mechanism to actuate an indoor or outdoor circuit breaker.

To ensure reliable operation of a circuit breaker operation mechanism over many years, all mechanical parts have to be protected against water, snow, dust and the like. Furthermore, to save to protect operating personnel from injury, the enclosure has to enclose all the moving parts of the mechanism.

This mechanism comprises a main shaft which protrudes out of the enclosure, and which is connected to an actuating member of the circuit breaker.

To avoid an electric arc appearing in the circuit breaker when it is opened, the main shaft has to be rotated quickly and accurately along a predetermined rotational path. More specifically, if the electric contacts are opened at sufficient speed and at the appropriate time, the chances of appearance of an electric arc are almost zero.

For this reason, the operation mechanism comprises an actuating spring cooperating with cams and levers carried by secondary shafts, to actuate the main shaft. When the circuit is to be opened, the actuating spring is released to rotate the cams and levers carried by the secondary shaft, which in turn to rotate the main shaft at the appropriate speed along the predetermined rotational path.

With the operation being conducted in a very short time interval, the mechanical components are moved at high speed, and thus require that the mechanism be powerful.

As a result, the general structure of this type of mechanism, which can be seen for example in FIGS. 1 to 5 of patent document U.S. Pat. No. 7,227,091 is heavy. It comprises two or more supporting plates, to which are secured ball bearings carrying the main shaft and the secondary shafts, and other mechanical components.

Since this mechanism has to be protected from rain, snow and the like, it is installed into a sealed cabinet, which is made of metal sheets which are arranged together and sealed.

The aim of embodiments of the invention is to provide a solution to reduce the cost of such a system in order to render it more competitive.

SUMMARY OF INVENTION

Embodiments of the invention relate to an enclosure for the operating mechanism of a circuit breaker, this mechanism comprising a main shaft and secondary shafts carrying elements such as levers cams and gears, and an actuating spring, wherein this enclosure comprises: a base having a generally parallelepiped shape with an open face, this base comprising a bottom wall opposite to its open face, this bottom wall having blind holes to receive bearings carrying first extremities of the secondary shafts and a through hole receiving the main shaft to allow it protrude out of this base; a supporting part comprising a main wall to be mounted at the open face of the base, the main wall comprising through holes to receive bearings carrying the other extremities of the shafts; a cover to close the supporting part.

With this solution, the enclosure is both a chassis part which supports all the mechanical parts of the mechanism and which also protects this operation mechanism against external dust water and the like.

Embodiments of the invention also relate to an enclosure as defined above, wherein the supporting part is a flat piece.

Embodiments of the invention also relate to an enclosure as defined above, wherein the supporting part has a generally parallelepiped shape having an open face, its main wall being opposite to its open face to receive additional elements, such as position indicators, interlockings, electrical auxiliary switches, and wherein the cover closes the open face of the supporting part.

Embodiments of the invention also relate to an enclosure as defined above, wherein the base comprises an opening to which an external case is secured to receive the spring which actuates the mechanism.

Embodiments of the invention also relate to an enclosure as defined above, wherein the base comprises at its corners threaded holes perpendicular to its bottom wall to receive screws for securing the supporting part and the cover to the base.

DETAILED DESCRIPTION OF THE INVENTION

The basic idea of embodiments of the invention is an element having a parallelepiped shape closed on all its sides except the top which is covered by an additional part. All the mechanical and electrical parts are mounted inside this element before it is closed by a sealed cover. The element with its cover is both an enclosure and a strong frame for carrying all the operation mechanism.

Figure 1:
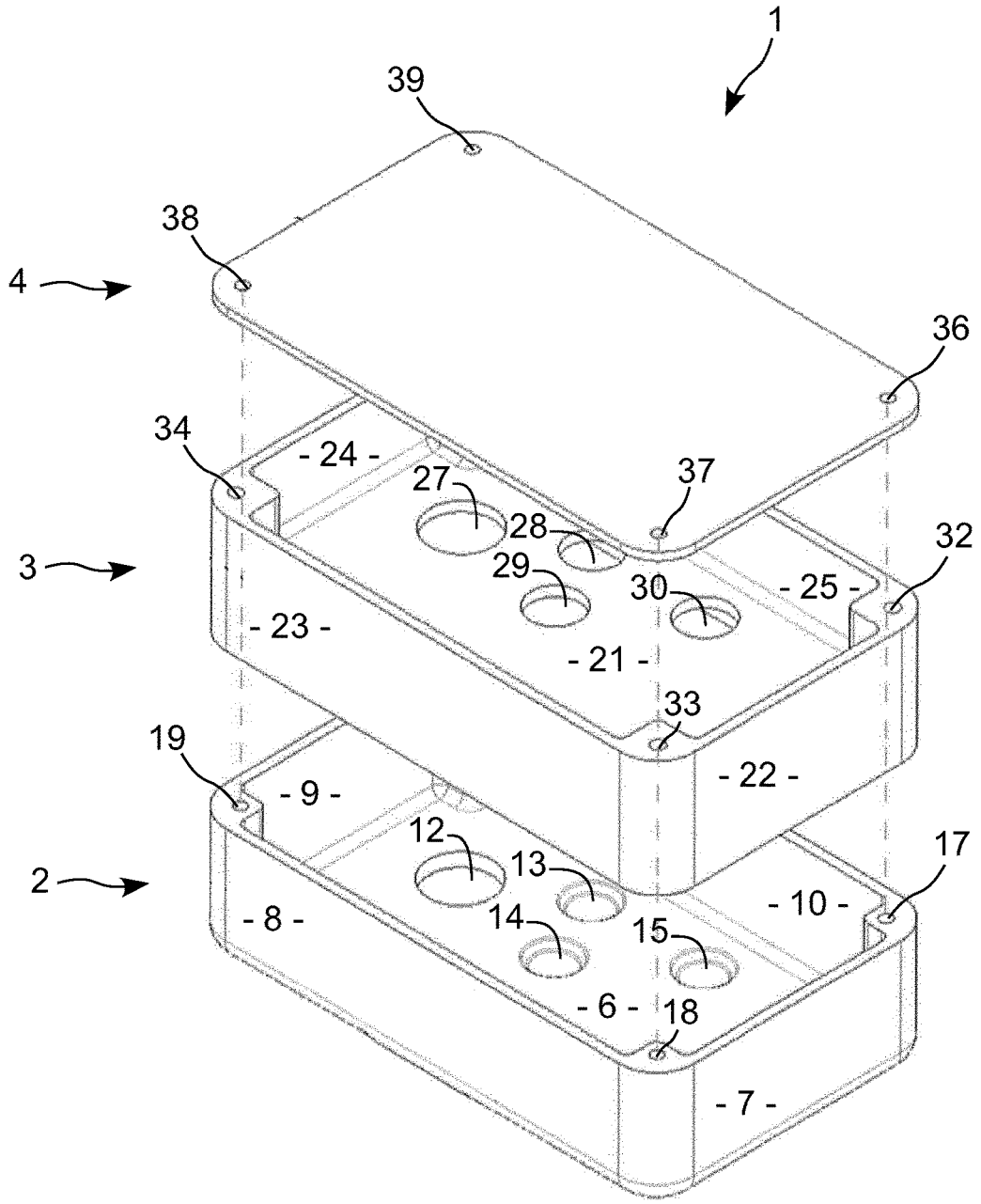
FIG. 1 is an exploded view of the enclosure.

As seen in FIG. 1, the enclosure 1 according to embodiments of the invention comprises a base 2 having a parallelepiped shape, a supporting part 3 also having a parallelepiped shape, and a cover 4.

The base 2 comprises a rectangular bottom wall 6, and four side walls 7, 8, 9, 10, each side wall being perpendicular to the bottom wall 6 and extending from one of the borders of the rectangular bottom wall 6.

The bottom wall 6 comprises at its inner face a through hole 12 intended to receive a ball bearing to carry the main shaft of the operation mechanism. It further comprises three blind holes 13, 14, 15 intended to receive ball bearings to carry three secondary shafts which carry the levers, cams and gears of the mechanism. The operation mechanism with its bearings and shafts is not shown on the figures.

Each corner of this base 2, i.e. each junction of two contiguous side walls comprises a threaded hole located in the thickness of the junction of the walls and extending perpendicular to the bottom wall 2. Three of these four threaded holes are visible in FIG. 1 and marked as 17, 18, 19.

The supporting part 3 is similar to the base 2. It has a generally parallelepiped shape open on one face: it comprises a rectangular bottom wall 21, four side walls 22, 23, 24, 25 perpendicular to the bottom wall 21 and each extending a corresponding border of the rectangular bottom wall 21.

The bottom wall comprises four through holes 27, 28, 29, 30 corresponding to the holes of the bottom wall 6 of the base 2. This four through holes receive corresponding ball bearings to carry the other extremities of the main shaft and of the secondary shafts.

Each corner of the supporting part, i.e. each junction of two contiguous side walls comprises a through hole perpendicular to the bottom wall. Three of these through holes are visible in the figures and marked as 32, 33, 34.

As seen in the figures, the cover 4 is a rectangular flat piece such as a metal sheet, which comprises four through holes at its corners, these through holes being marked as 36, 37, 38, 39.

When the case is mounted, the bottom of the supporting part 3 is located against the top edges of the side walls of the base 2, and the cover 4 is located against the top edges of the supporting part 3. Four screws firmly secure these three part to each other. Each screw is inserted in a through hole of the cover and in a corresponding through hole of the supporting part, and is screwed in a corresponding threaded hole of the base.

A gasket or a sealing compound can, in an embodiment, be provided between the base 2 and the supporting part 3, and also between the cover 4 and the supporting part 3, to ensure appropriate sealing of these parts.

As mentioned above, the base part comprises all the main mechanical parts of the operation mechanism: the main shaft and the secondary shafts with their corresponding levers, cams and gears. All these shafts are carried at each extremity by a corresponding bearing mounted in the holes 12-15 of the bottom wall 6 of the base 2 and in the holes 27-30 of the bottom or main wall 21 of the supporting part 3. The actuating spring of the operation mechanism is also mounted into the base 2.

The supporting part 3 comprises additional elements of the mechanism such as position indicators, interlockings, electrical auxiliary switches, and the like. Since the holes of the bottom wall 21 of the supporting part are through holes, the extremities of the shafts can protrude partly in the supporting part 3 to be connected to or to cooperate with the additional elements mounted into this supporting part 3.

As for the actuating spring of the operation mechanism, it can be mounted into the base with the other mechanical components if its dimensions are not too large. But if the dimensions of this spring are too large, and especially if the spring is too long, this spring can be mounted in an additional case according to the second embodiment of the invention shown in FIG. 2.

In this second embodiment, the enclosure comprises a case 41 having the general shape of a cylinder with an oblong base, which is closed at one extremity and open at its other extremity. The open extremity comprises a flange 42 integral with the cylinder, this flange being perpendicular and surrounding this extremity, and enabling this case 41 to be secured to the side wall 8 of the base, by means of bolts or the like.

The base 2' of this second embodiment is similar to the base 2 of the first embodiment, except that its side wall 8 comprises a corresponding oblong through hole marked as 43, and surrounded by corresponding through holes to receive fixation bolts. Accordingly, the spring can be installed into the cylindrical case 41 which protrudes out of the base 2', and which is secured to it by the fixation bolts traversing the flange 43 and the wall 8. One extremity of the spring protrudes inside the base 2', allowing this spring to be released to allow its free end to actuate the moving parts of the operation mechanism, in order to move the main shaft at appropriate speed.

Figure 2:
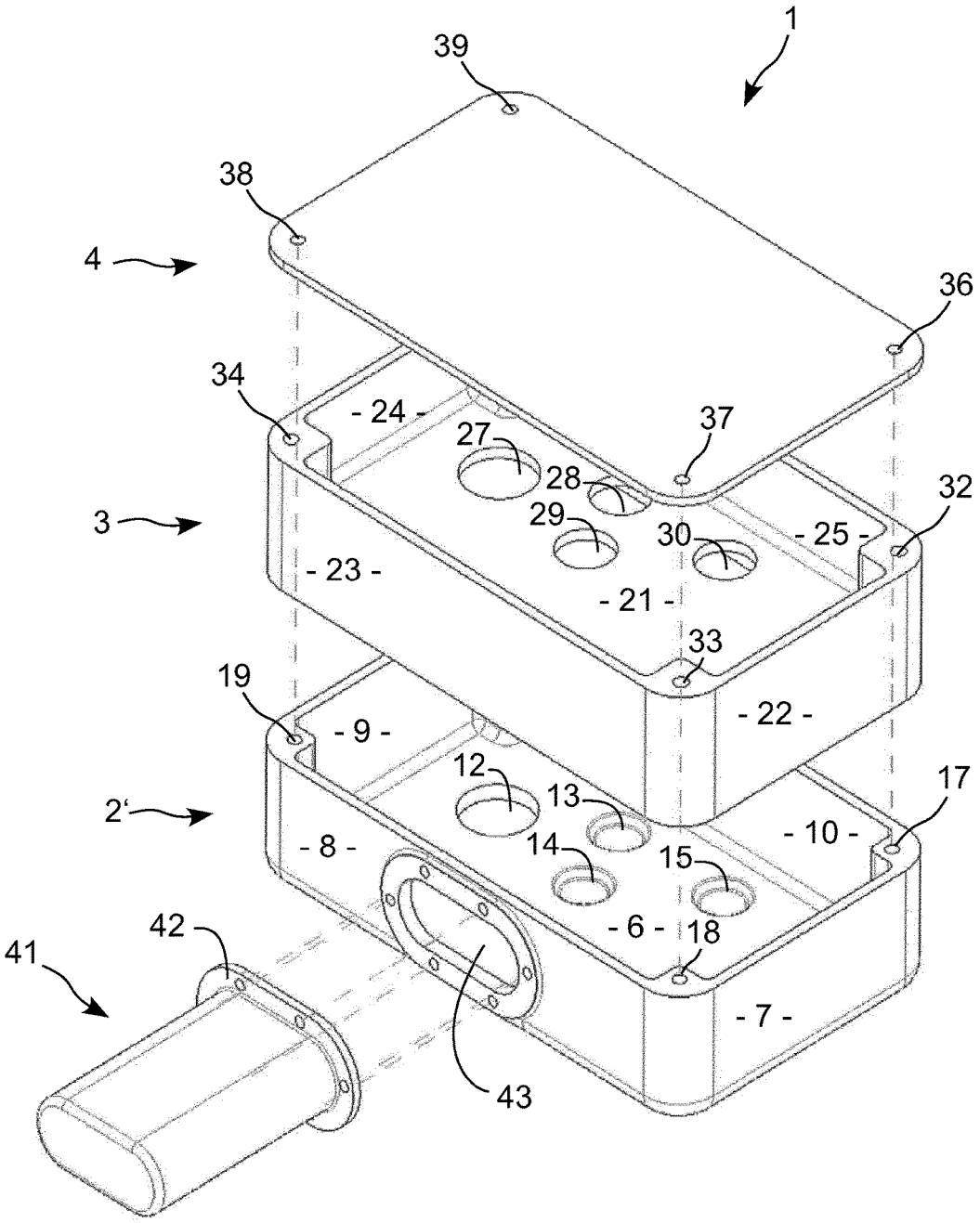
FIG. 2 is an exploded view of the enclosure.

As seen in FIG. 2, the general structure in this second embodiment of the invention is similar to the one of the first embodiment: the base of the supporting part 3 is applied against the edges of the side walls of the base 2', and the cover 4 is located and secured onto the open face of the supporting part 3 to close it.

The base 2', the supporting part 3 and the cover 4 are secured to each other by screws, in the same way as in the first embodiment. The main parts of the operating mechanism are mounted into the base 2', and the additional parts or auxiliary parts of this mechanism are mounted into the supporting member, and connected to the corresponding shafts.

Figure 3:
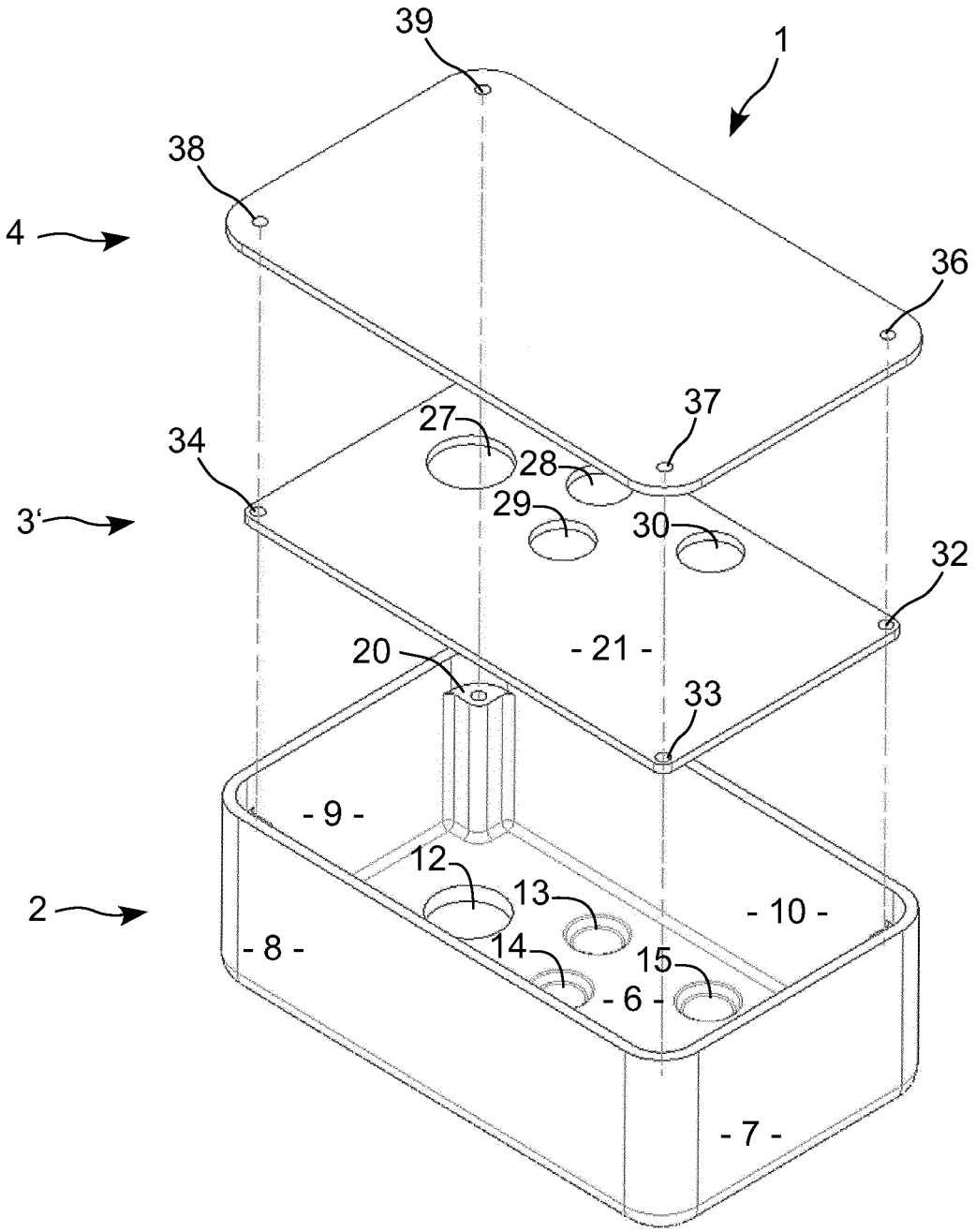
FIG. 3 is an exploded view of the enclosure.

In a third embodiment of the invention which corresponds to FIG. 3, the supporting part 3', is reduced to just a flat piece which forms a bottom wall 21.

As visible from FIG. 3, this rectangular bottom wall is similar to the bottom wall of the supporting part of the first and second embodiments of the invention. It comprises four through holes 27-30 to receive the bearings carrying the extremities of the shafts, and it also comprises through holes 32-34 at each corner, to be traversed by the screws used to secure the cover 4 and the supporting part 21 to the base 2.

The enclosure according to this third embodiment of the invention is adapted to a situation where the operation mechanism is more simple, i.e. comprises a smaller amount of components, allowing the whole operation system to fit entirely within the base element 2.

In these three embodiments of the invention discussed above, the base 2 and the supporting element 3 are made of casted aluminum in order to be strong enough to firmly support the mechanical components of the operation mechanism.

Except those of the main-shaft, all bearing bores are executed as blind holes to ensure that no sealing is necessary. The main shaft which protrudes out of the base 2 to be connected to the operating member of the circuit breaker is either sealed by a rotary shaft seal or by the circuit breaker housing.

The cover can be fixed by screws, as explained above, but it can also be provided with hinges to allow easy access to the electric equipment as well as the manual operated parts. If necessary, windows in the cover can be provided to allow the position indicators to remain visible even when the cover is closed.

What is claimed is:

1. An enclosure for the operating mechanism of a circuit breaker, this mechanism comprising a main shaft and secondary shafts carrying elements such as levers cams and gears, and an actuating spring, wherein the enclosure comprises:

- a base having a generally parallelepiped shape with an open face, this base comprising a bottom wall opposite to its open face, this bottom wall having blind holes to receive bearings carrying first extremities of the secondary shafts and a through hole receiving the main shaft so as to allow it protrude out of this base;
- a supporting part comprising a main wall to be mounted to the open face of the base, the main wall comprising through holes to receive bearings carrying the other extremities of the shafts;
- a cover to close the supporting part.

2. The enclosure according to claim 1, wherein the supporting part is a flat piece.

3. The enclosure according to claim 1, wherein the supporting part has a generally parallelepiped shape having an open face, its main wall being opposite to its open face to receive additional elements, such as position indicators, interlockings, electrical auxiliary switches, and wherein the cover closes the open face of the supporting part.

4. The enclosure according to claim 1, wherein the base comprises an opening to which an external case is secured to receive the spring which actuates the mechanism.

5. The enclosure according to claim 1, wherein the base comprises at its corners threaded holes perpendicular to its bottom wall to receive screws for securing the supporting part and the cover to the base.

* * * * *